United States Patent [19]

Aiello et al.

[11] Patent Number: 5,004,434

[45] Date of Patent: Apr. 2, 1991

[54] PRINTED CIRCUIT BOARD EDGE CONNECTOR

[75] Inventors: Richard E. Aiello, Tobaccoville; Donald G. Stillie, Winston-Salem; Christopher L. Allgood, Lewisville, all of N.C.

[73] Assignee: AMP Incorporated, Harrisburg, Pa.

[21] Appl. No.: 590,541

[22] Filed: Sep. 28, 1990

Related U.S. Application Data

[63] Continuation-in-part of Ser. No. 493,065, Mar. 12, 1990, abandoned.

[51] Int. Cl.[5] ..... H01R 23/70

[52] U.S. Cl. ..... 439/636; 439/858; 439/861; 439/746

[58] Field of Search ..... 439/842, 851-858, 439/861, 862, 80-83, 630-637, 744, 746

[56] References Cited

U.S. PATENT DOCUMENTS

| | | | |
|---|---|---|---|
| 3,075,167 | 1/1963 | Kinkaid | 439/636 |
| 3,555,493 | 1/1971 | Baumanis | 439/636 |
| 3,720,907 | 3/1973 | Asick | 439/636 |
| 3,787,801 | 1/1974 | Teagno et al. | 439/258 R |
| 3,808,578 | 4/1974 | Hansen | 439/636 |
| 4,066,325 | 1/1978 | Pearce, Jr. et al. | 439/637 |

*Primary Examiner*—David L. Pirlot

*Attorney, Agent, or Firm*—Robert W. Pitts; Allan B. Osborne

[57] ABSTRACT

A printed circuit edge connector having a pluraltiy of electrial terminals, each of which has a compliant contact spring opposed to a relatively more rigid support arm is disclosed. The surface of the contact spring is opposed to an edge of the support arm because the contact spring is bent transversely relative to an arm which is coplanar with the support arm. Each of the terminals is received within aligned channels and cavities and an insulative housing, each of which extend parallel to a board receiving slot opening on the upper face of the housing. The base of the terminals are received within the cavities and include terminal retention means engagable with the housing in the cavities to retain the terminals in the housing.

4 Claims, 11 Drawing Sheets

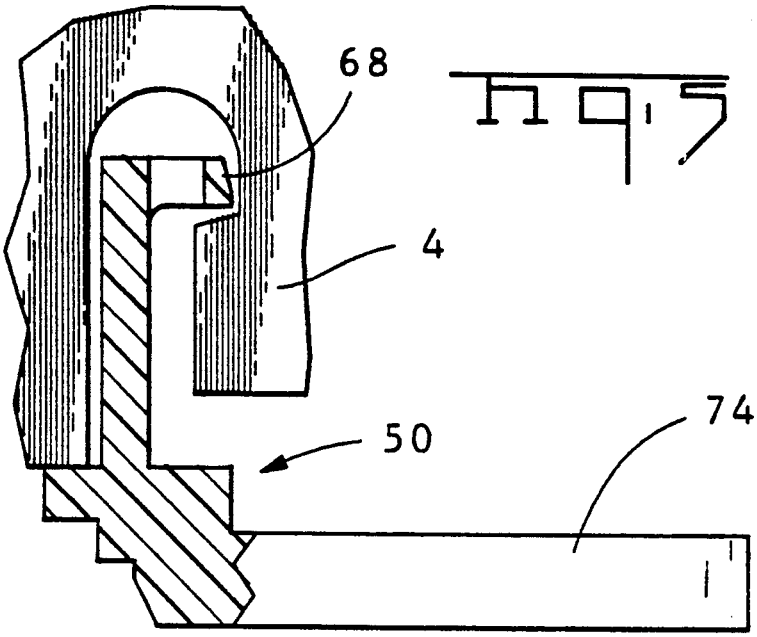
Fig. 5
Fig. 4
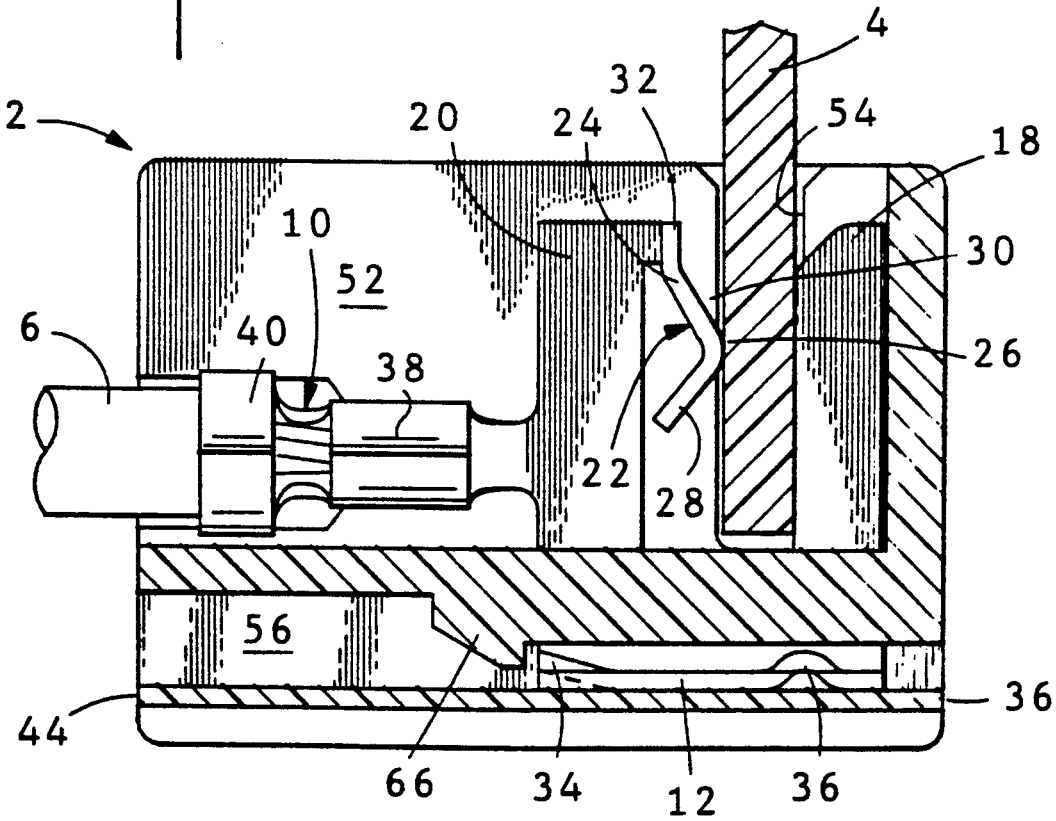

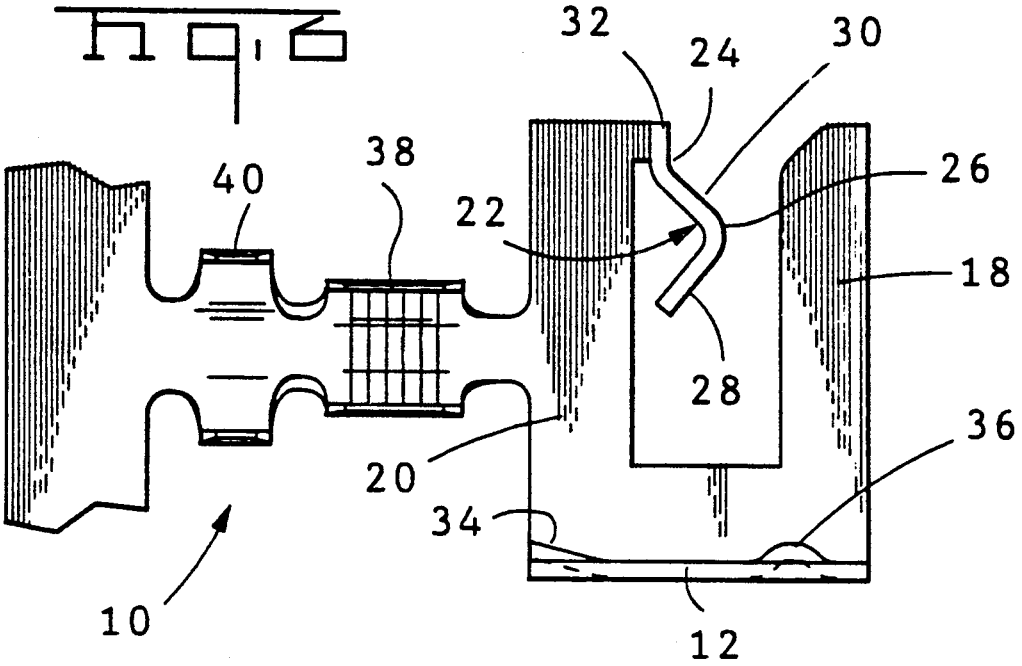
32
24
30
40
38
26
22
18
28
36
20
34
10
12
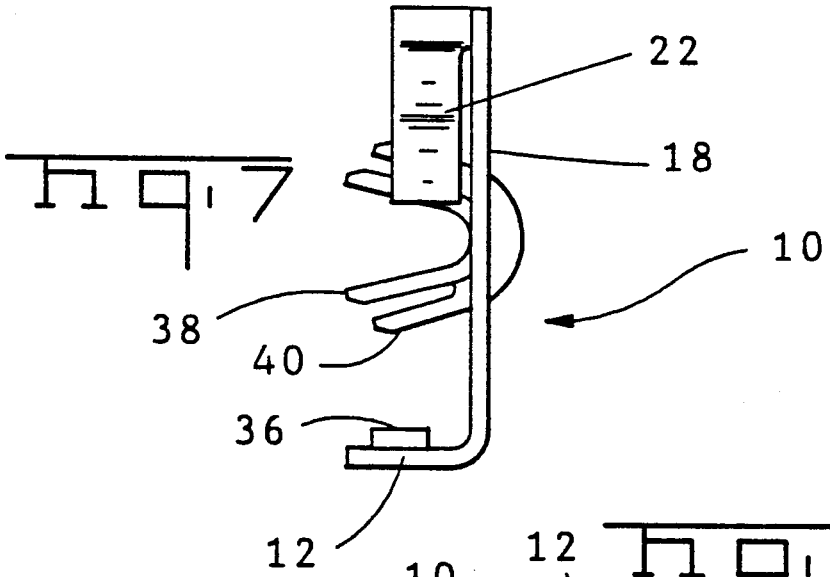
22
18
10
38
40
36
12
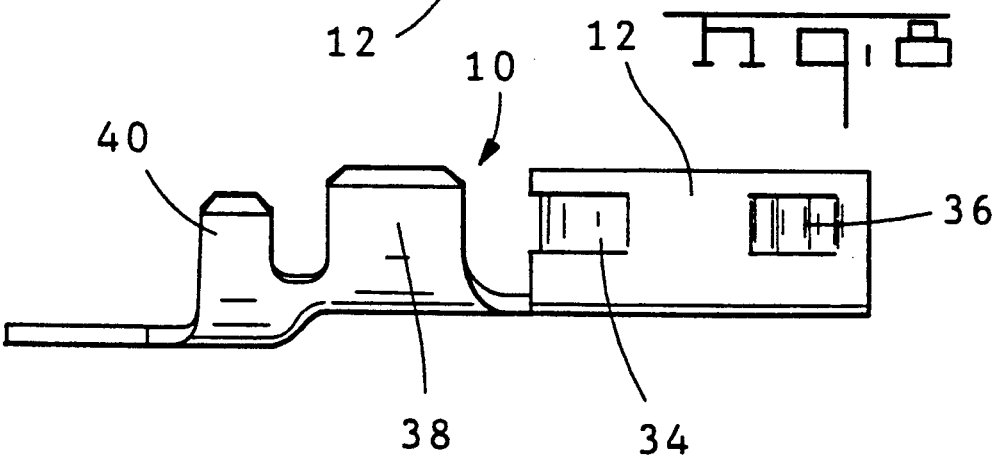
12
10
40
36
38
34

PRINTED CIRCUIT BOARD EDGE CONNECTOR

This application is a continuation-in-part of U.S. patent application Ser. No. 07/493,065 filed March 12, 1990, now abandoned.

BACKGROUND OF THE INVENTION

1. Field of the Invention

This invention relates to an electrical connector for establishing an electrical connection between a printed circuit board and a plurality of wires and more particularly relates to a connector having a plurality of terminals each suitable for forming a compliant electrical contact with conductive paths located on one side of a printed circuit board.

2. Description of the Prior Art

A number of conventional electrical connectors have been used to establish contact with conductive paths located along one or both sides of a printed circuit board adjacent the edge of the printed circuit board. Electrical connectors suitable for establishing electrical contact with terminals along one side of a printed circuit board fall into generally two categories. Some electrical connectors, such as that shown in U.S. Pat. No. 3,075,167 employ edge stamped contact terminals suitable for establishing electrical contact with conductive pads along the stamped edge of the terminal. Other connectors employ a more compliant configuration in which terminals are stamped and formed in such a manner that a leaf spring having a flat surface establishes the electrical contact with the conductive pads on the printed circuit board. These leaf spring type contacts are more compliant than the edge stamped configurations. One electrical connector employing a leaf type contact is the Bifurcated Leaf connector manufactured and sold by AMP Incorporated.

U.S. Pat. No. 3,075,167 discloses a printed circuit board electrical connector having flag type terminals. These flag type terminals are edge stamped terminals. Contact with the printed circuit board is established by a pair of parallel contact arms which have contact surfaces adjacent their ends. These contact arms are part of the same metal stamping, and each arm is joined to a web portion at its base. The terminals are positioned with opposed arms on opposite sides of board receiving slot and the printed circuit board is inserted between the opposed arms. Since these opposed arms comprise edge stamped members, they are relatively rigid and not very compliant. Thus, these terminals have a limited deflection range. One problem which can be encountered with this type of connector is that one or both arms can be overstressed by a printed circuit board that is either the wrong size or is inserted improperly into the connector. For example, the printed circuit board can be inserted on an angle thus overstressing one or both of the contact arms. A printed circuit board can also be inserted into a connector of this type and the contact pads will not properly engage one of the contact points adjacent to contact pads. For example, the board may be warped, thus reducing the normal force with specified contact terminals. Other problems which may be encountered with a connector of this type is that the thickness of the printed circuit boards may not be properly controlled, again, causing potential problems.

It should be understood, however, that electrical connectors of this type have been reliably used. Reliable use of connectors of this type is, however, dependent upon a close monitoring of the connector board interface. One additional problem that results with connectors of this type is that the contact force between the terminals and the conductive pads may vary over the life of the connection. This is in part due to the fact that a precise positioning of the board relative to the terminals cannot be assured, and because the terminals themselves are not relatively compliant.

U.S. Pat. No. 3,787,801 discloses another connector for establishing a contact with a printed circuit board. This connector also employes flag type terminals. Those terminals are formed upwardly from an intervening web, and embossed contact surfaces are formed adjacent the end of the opposed arms. In this connector, the opposed arms are substantially identical. As such, the contact force applied by each contact arm is substantially identical for a given deflection. However, the deflection of the contact arm is again dependent upon the structure and configuration of the printed circuit board. Since the contact force between the terminal and the conductive pad on the printed circuit board is dependent upon the deflection of the contact terminal, it is difficult to insure the precise contact force which will be maintained, especially over the life of the terminal.

U.S. Pat. No. 3,720,907 discloses another printed circuit board electrical connector having two relatively compliant opposed arms extending upwardly from an intervening web. Note that the contact force generated by the opposed arms for this relatively compliant terminal is also dependent upon the precise positioning of the printed circuit board, in much the same manner as with the connector shown in U.S. Pat. No. 3,787,801.

The electrical connectors depicted in the preferred embodiment of the invention disclosed herein provide a means for establishing a compliant electrical contact with conductive pads on a printed circuit board, while at the same time, establishing a relatively assured deflection of the compliant spring comprising a part of the terminal using the connector. This connector employs a relatively rigid support arm opposed to a relatively compliant contact spring. The relatively rigid support arm engages one side of the printed circuit board to precisely position the printed circuit board relative to the deflectable contact spring. Virtually all the deflection which occurs in the terminal is limited to the deflection of the single contact spring, thus establishing a well defined contact force which is not only present at the time of initial termination but, which can be maintained and defined within prescribed limits over the life of the interconnection.

SUMMARY OF THE INVENTION

An electrical terminal for establishing electrical contact with conductive pads on a printed circuit board includes a terminal having a contact spring spaced from a support arm. The contact spring and a support arm define a slot into which a printed circuit board can be inserted with the conductive pads on the printed circuit board being disposed adjacent the contact spring. The support arm is positioned within a plane which is perpendicular to the slot so that the support arm remains relatively rigid. The contact spring is bent at a right angle relative to the support arm so that the contact spring is relatively more compliant than the support arm. Virtually all the deflection is limited to the compliant contact spring. In the preferred embodiments of this invention, the support arm and contact spring are part of a one piece terminal. The contact spring is bent relative to one of two arms which extend upwardly from a base to form a U-shaped section. The other arm comprises a support arm. The contact spring is positioned so that a flat contact surface which is inclined form to a contact point at the apex of the contact spring, is adjacent the slot and opposed to an edge of the relatively more rigid support arm.

A plurality of these terminals can be positioned within an insulative housing to form an electrical connector. The insulative housing includes a board receiving slot with a plurality of transversely extending channels into which the terminals are positioned. In the preferred embodiment, cavities extend adjacent the slot and the base of each of terminals is positioned within the cavity. The slit between the channels and the cavities is provided so that the one piece terminals can be inserted into the housing from the front face. Terminal retention means are provided to secure the terminals to the housing. In the preferred embodiment of this invention, this retention is established by engagement of a tab on the terminal with a surface on the associated cavity in the housing. In an alternate embodiment, a resilient terminal receiving lance is molded into the housing and this lance engages an aperture on the base of the terminal.

BRIEF DESCRIPTION OF THE DRAWINGS

FIG. 3 is a front elevational view of the preferred embodiment of the insulative housing.

FIG. 4 is a section view substantially taken along section lines 4—4 FIG. 1, but showing a terminal position within the housing in engagement with a printed circuit board.

FIG. 5 is a fragmentary cross-sectional view illustrating the manner in which the printed circuit board is latched to the housing.

FIG. 6 is a side view of the preferred embodiment of the terminal used in the embodiment of FIG. 1.

FIG. 7 is a end view of the preferred embodiment of the terminal.

FIG. 8 is a side view of the preferred embodiment of the terminal.

DETAILED DESCRIPTION OF THE PREFERRED EMBODIMENTS

Figure 1:
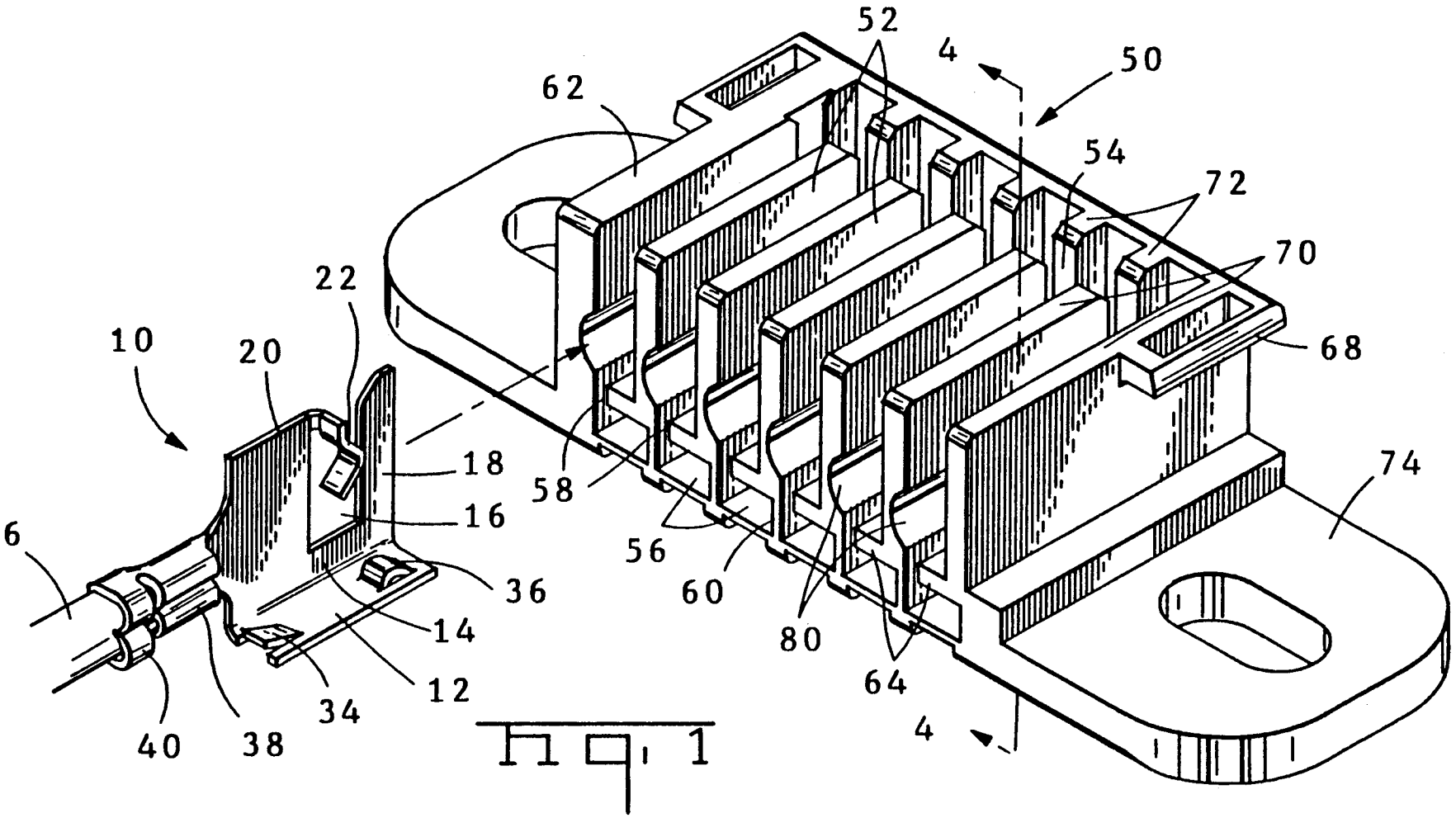
FIG. 1 is a perspective view of the preferred embodiment of the connector showing a terminal exploded from an insulative housing.
Figure 2:
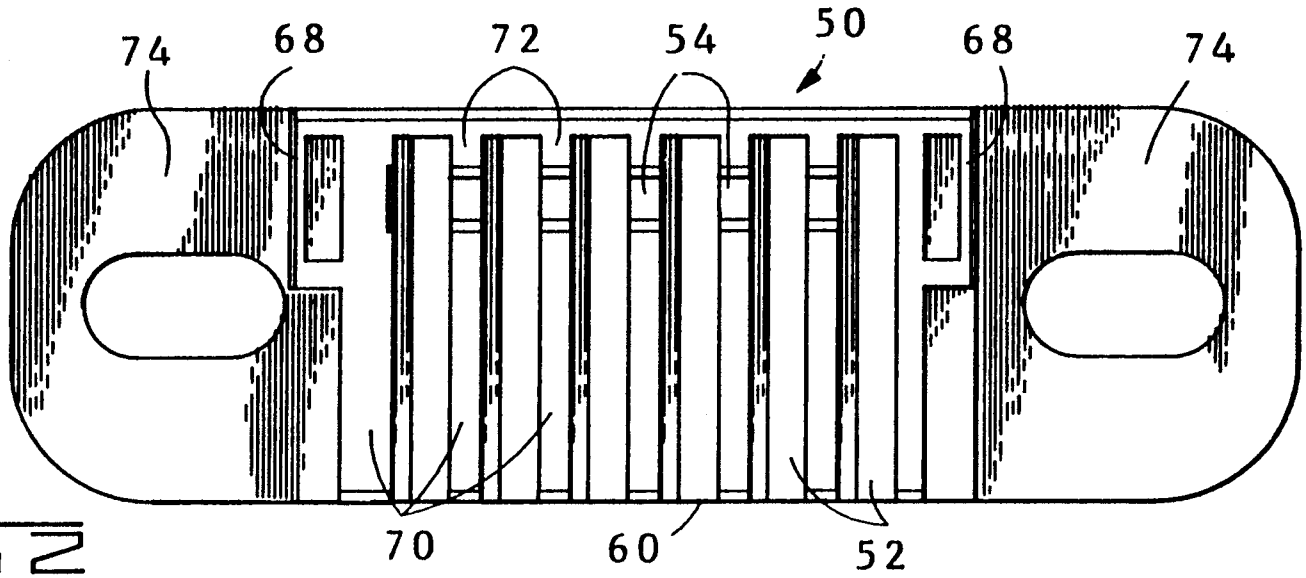
FIG. 2 is a top plan view of the preferred embodiment of the insulative housing.
Figure 1:
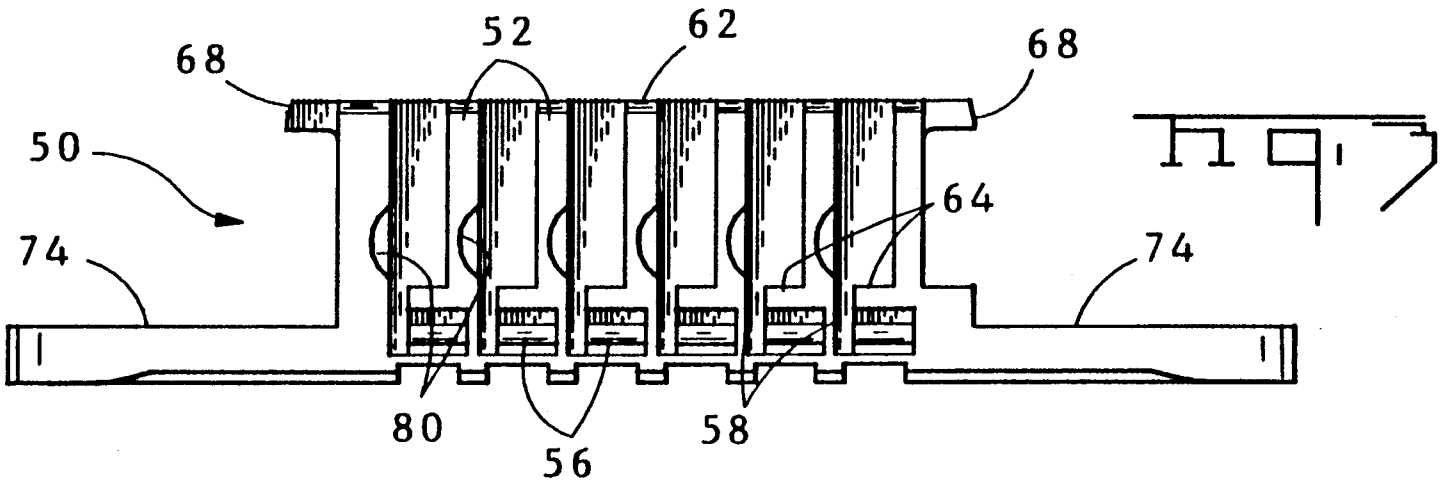
Figure 9:
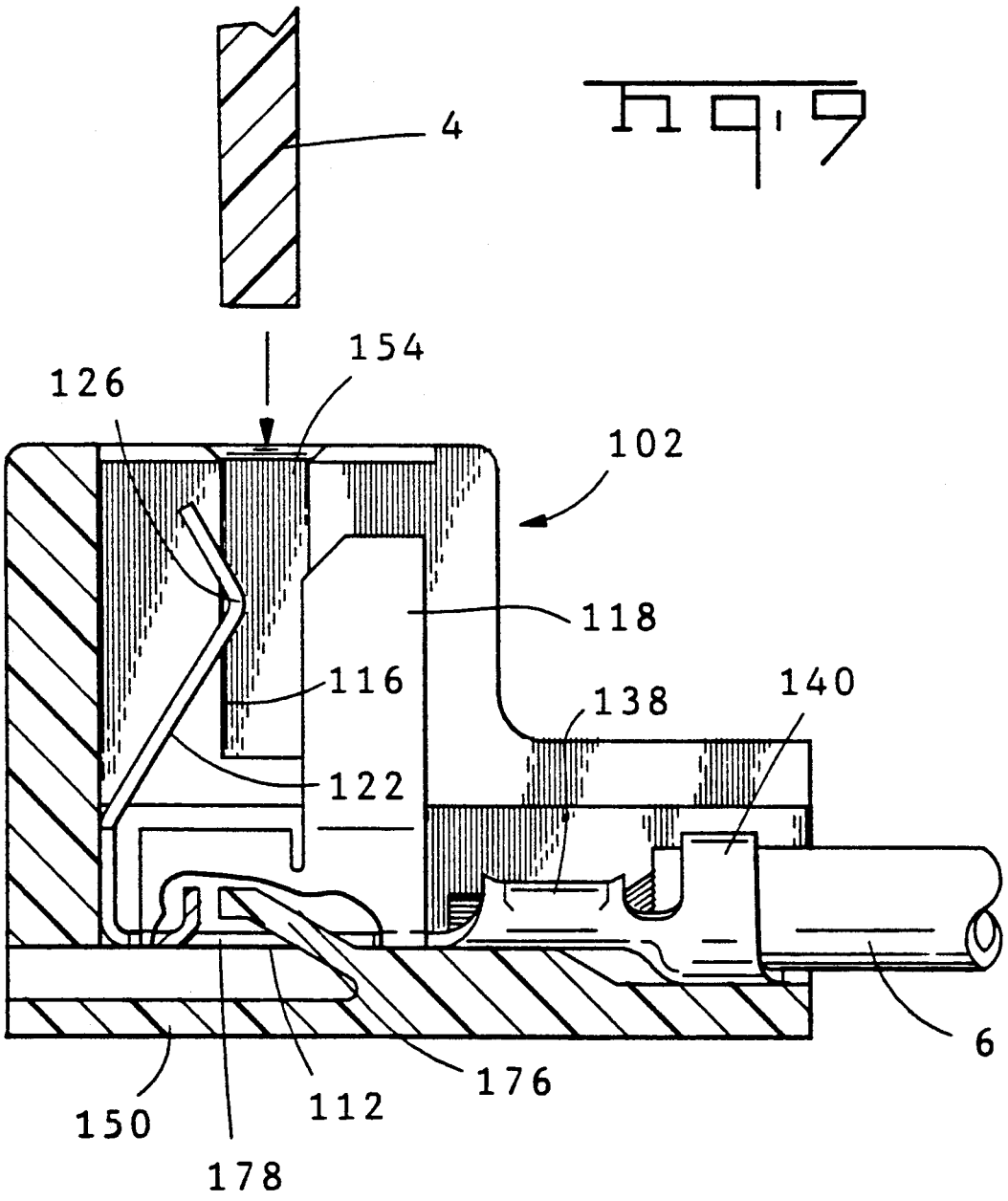
FIG. 9 is a sectional view of an alternate embodiment of the connector.
Figure 10:
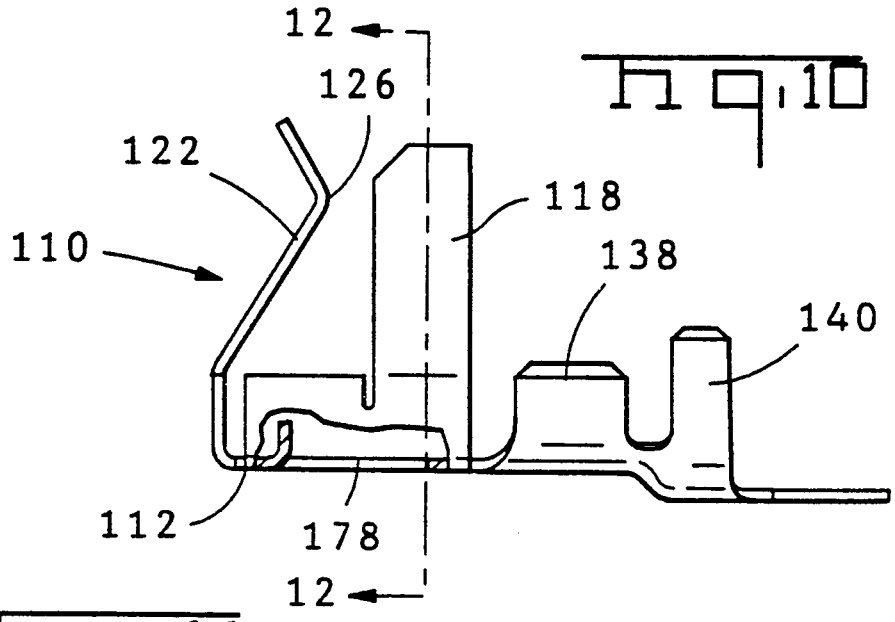
FIG. 10 is a side view of the alternate embodiment of the terminal.
Figure 11:
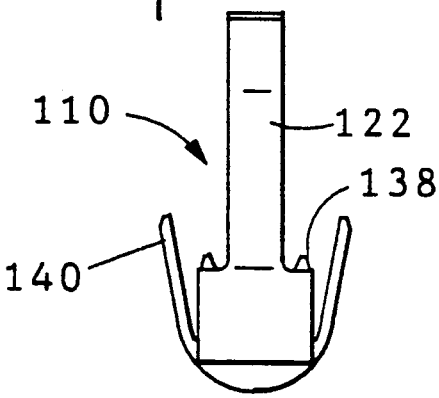
FIG. 11 is an end view showing the front of the terminal of FIG. 10.
Figure 12:
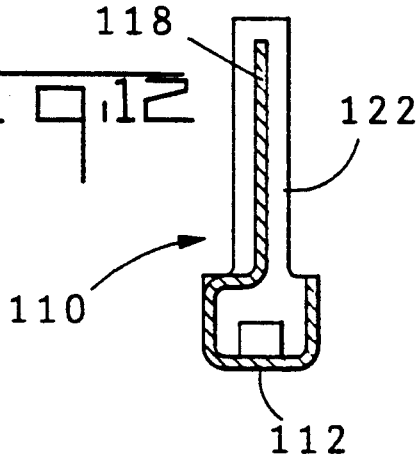
FIG. 12 is a section view of the terminal shown in FIG. 10 taken along section lines 12—12 in FIG. 10.
Figure 13:
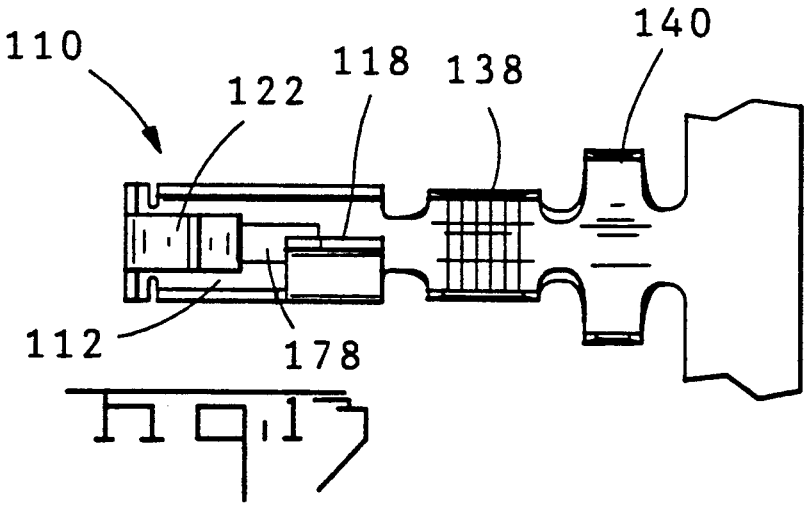
FIG. 13 is a top view of the terminal shown in FIG. 10.
Figure 14:
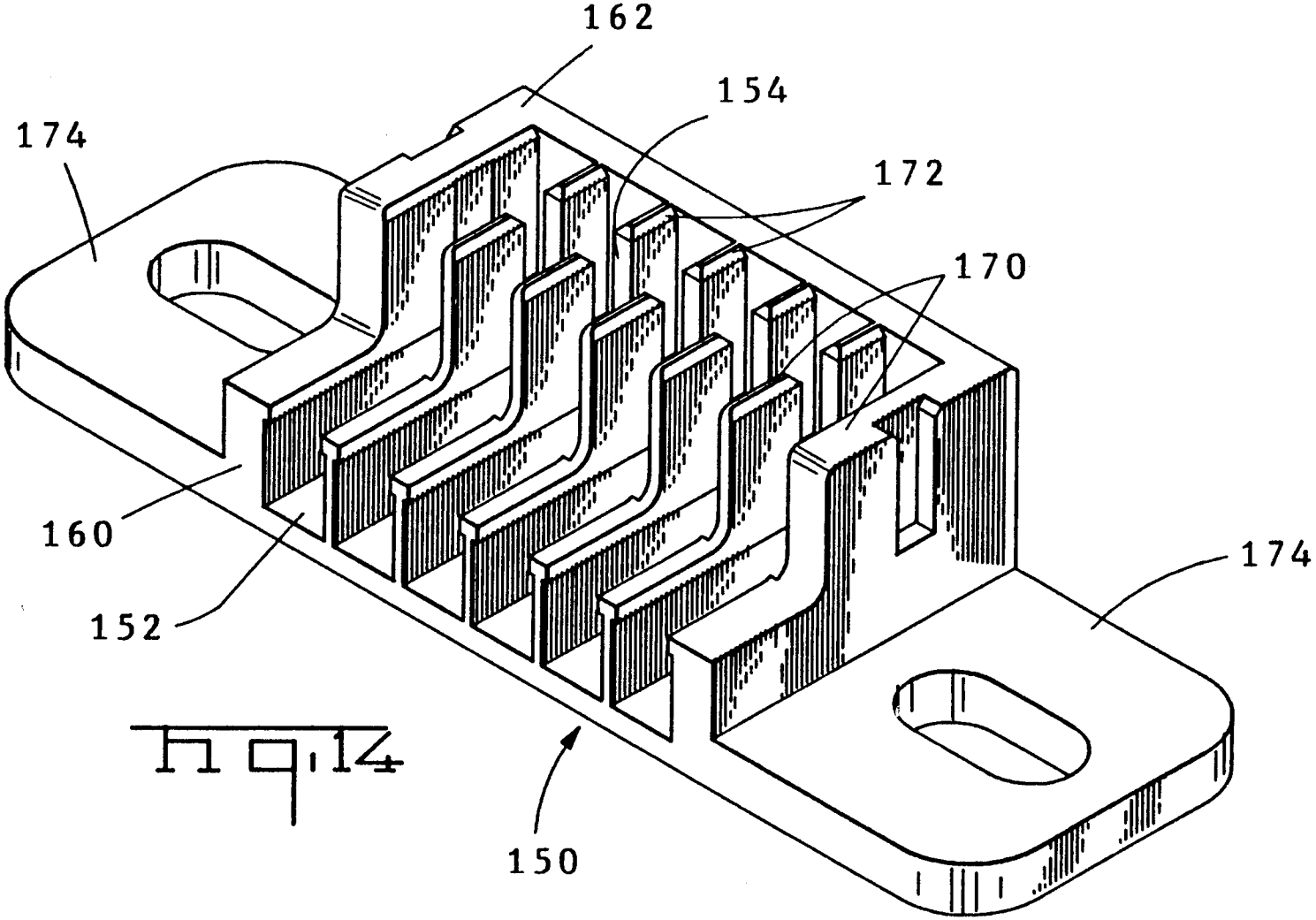
FIG. 14 is a perspective view of the alternate embodiment of the housing.
Figure 15:
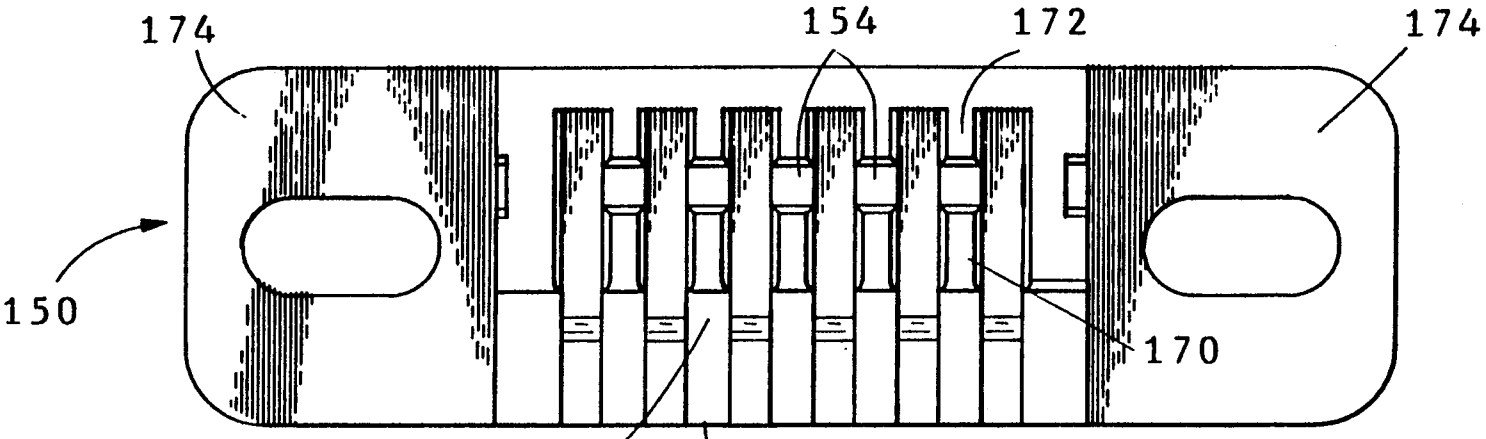
FIG. 15 is a top plan view of the housing shown in FIG. 14.
Figure 16:
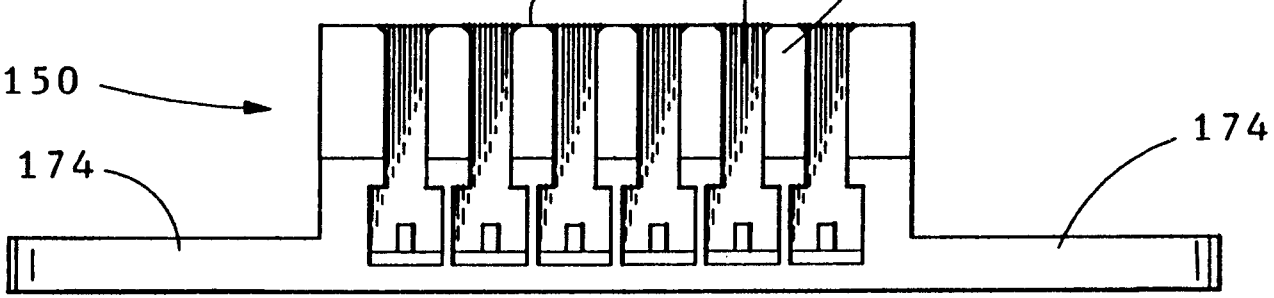
FIG. 16 is a front elevational view of the housing shown in FIG. 14.

The preferred embodiment of this invention is depicted in FIGS. 1 through 8. FIGS. 9 through 16 depict an alternate embodiment. Still another embodiment is shown in FIGS. 17 through 21. Each of the embodiments of this invention depicted herein is intended to establish an electrical interconnection between the plurality of wires 6 and a printed circuit board 4. The electrical connector 2 employs a plurality of electrical terminals 10 each of which is intended to establish an electrical interconnection between a single wire 6 and a single conductive pad 8 on the printed circuit board 4.

Each of the electrical terminals 10 comprises a one piece stamped and formed member having resilient characteristics. Each terminal 10 has a wire contact section and a board contact section. Each terminal 10 has a base 12 with a U-shaped section 14 extending upwardly from one side edge of the base 12. The U-shaped member 14 has a slot 16 formed between two upwardly extending arms or opposed members 18 and 20. Slot 16, as well as the arms 18 and 20, extends upwardly from the base 12. In one embodiment of this invention the U-shaped section 14 includes two coplanar arms. Adjacent edges of the two arms are opposed and spaced apart on opposite sides of the slot 16. In the embodiment of this invention the two arms 18 and 20 are perpendicular to the base 12 and the two arms 18 and 20 extend upwardly from one side edge of the base. One arm 18 comprises a support arm and is positioned within a plane which is perpendicular to the slot 16 so that the support arm can remain relatively rigid. The entire support arm 18 extends perpendicular to the base 12.

The other arm 20 includes a resilient contact spring 22 in the form of a leaf spring. The resilient contact spring 22 is joined to the edge of the arm 20 adjacent the support arm 18 and on the opposite side of the slot 16. The resilient contact spring 22 extends transversely to a plane containing the support arm 18. Resilient contact spring 22 is resiliently deflectable away from the support arm 18 so that insertion of a printed circuit board between the contact spring 22 and the support arm 18 deflects the contact spring, with the support arm 18 supporting a side of the printed circuit board 4 which is opposite from the side on which conductive pads 8 are positioned. In this manner the contact spring forms a relatively more resilient or compliant member than the relatively more rigid support arm 18. The resilient contact or leaf spring 22 is joined to the arm 18 at its upper end 24. Compliant contact spring 22 is inclined to the support arm 18 and extends to an apex 26 which forms a contact point for engagement with conductive pads 8. The contact point defined at apex 26 is spaced from the support arm 18 to define the slot 16 into which a printed circuit board can be inserted. The contact spring 22 continues from apex 26 to a second or lower end 28 which is spaced further from the opposed edge of support arm 18 than the apex 26. A contact surface 30 is formed on the face of the contact spring 22 facing the slot 16 and directly opposed to the edge of support arm 18.

The resilient contact spring 22 is joined to the arm 20 along a bend line 32 located at the upper end 24 of the contact spring 22. The contact spring 22 is deflectable relative to this bend line which is parallel to the support arm 18. The portion of the contact spring 22 between the bend line 32 and the lower end 28 is separate from the arm 20. Thus, the contact spring 22 extends downwardly from the upper end 24 adjacent the bend line 32 towards the base 12 of the terminal 10. By bending the portion of the arm 18, which constitutes the resilient contact spring 22, at a right angle relative to the support arm 18, the contact spring 22 is relatively more compliant than the support arm 18. Contact spring 22 and the support arm 18 are, however, still part of the one piece member formed of resiliently conductive material. By bending the contact spring 22 perpendicular to the plane containing the support arm 18, an edge of the support arm 18 will be positioned so that it is substantially opposed to the contact surface 30 on the contact spring 22. It should be understood, however, that the support arm 18 is offset relative to the center of the contact spring 22.

Both the contact spring 22 and the support arm 18 are integral with the base 12. The base 12 includes terminal retention means engagable with an insulative housing 50 to secure the terminal 10 to the insulative housing 50. A tab 34 is struck upwardly from the base 12. This tab 34 comprises a portion of the terminal retention means. Tab 34 is located adjacent the forward end of the base 12. A raised portion or bump comprising a section which is sheared, along its side edges, from to the base and is then formed upwardly, is located at a point spaced from the tab 34. This raised portion 36 is located adjacent the rear edge 42. Both the tab 34 and the raised portion 36 extend upwardly from the otherwise generally flat base 12. As will be described hereinafter, the tab 34 and the raised portion 36 cooperate with the housing to form terminal retention means on each terminal 10 engagable with the housing so that each terminal is retained in the housing for engagement with the printed circuit board 4 when inserted in the housing.

A wire contact section comprising a crimp barrel 38 and a strain relief 40. This wire contact section extends from the edge of arm 2 which faces the front of the terminal. Note that the wire contact section extends transverse to the base 12.

The insulative housing 50 of this invention has a plurality of terminal receiving channels 52 which intersect a board receiving slot 54. A plurality of cavities 56 are also located in the housing. One cavity 56 is located below each channel 52 and the cavities 56 extend parallel to the channels 52. Slits 58 extend between each channel 52 and the adjacent cavity 56. The channels 52 extend inwardly from the front face 60. Front face 60 is spaced from the board receiving slot 54. The board receiving slot 54 is in turn open along an upper face 62 of the housing. The board receiving slot 54 is configured such that a printed circuit board 4 can be inserted into the board receiving slot 54 through the upper face of the housing. Each of the channels 52 is also open along the upper face 62.

The channels 52 are separated from the cavity 56 by intermediate wall 64. A slit 58 extends through the intermediate wall 64 between each associated channel 52 and cavity 56. A shoulder 66 is located on the lower surface of the intermediate wall 64 in each cavity 56.

Each of the channels 52 is further defined by upwardly extending parallel barrier walls 70. Each barrier wall 70 extend upwardly from intermediate wall 64 and are perpendicular to the intermediate wall 64. The barrier walls 70 are located along one side of board receiving slot 54 and extend perpendicular to the board receiving slot 54. The channels 52 are continued on the opposite side of the board receiving slot 54 by upwardly extending partition 72. These partitions 72 are coplanar with associated barrier wall 70. The channels 52 formed by the barrier wall 70 and the partition 72 thus intersect the board receiving slot 54. Ribs 68 are located on the exterior of the outermost barrier walls 70 and comprise board retention means for engaging a printed circuit board 4 inserted into the board receiving slot 54. These board retention ribs 68 retain the printed circuit board 4 in the board receiving slot 54. These ribs are dimensioned to engage corresponding cutouts in one edge of the printed circuit board in the manner substantially shown in FIG. 5. Board mounting flanges 74, of conventional construction, extend outwardly from the lower edge of the outermost barrier walls 70. These board mounting flanges contain openings suitable for receiving fastener means for securing the housing 50 to a panel.

Each of the terminals 10 is positioned in the housing such that the base 12 is received within a cavity 56 and the pair of opposed arms 18, 20 are positioned in an associated channel 52. Terminals 10 are positioned such that the support arm 18 will be located on one side of the board receiving slot 52 and the other arm 18, containing the contact spring 22, will be positioned on the other side of the board receiving slot 54. In one embodiment of this invention, the wire contact section comprising the wire crimp barrel 38 and the strain relief 40 will be positioned within an associated channel 52. Note that each channel includes a semi-cylindrical cutout 80 which provides clearance for the wire contact section. The terminals 10 can be positioned within associated channels 52 and cavities 56 by inserting the terminals through the open front base 60 of the housing in a direction transverse to the board receiving slot 54. The wire contact section consisting of the wire crimp barrel 38 and the strain relief 40 is oriented so that the terminals 10 can be inserted into the channel 52 in a direction parallel to the orientation of the wire 6 terminated to terminal 10. In other words, the wire will extend directly out from the front end of the channel 2. The width of each channel is greater than the width of the transversely fitting contact spring 22 so that the contact spring 22 can deflect within the channel 52 when the contact spring engages the printed circuit board 4 inserted into the board receiving slot 54.

When a board 4 is positioned within the board receiving slot 54, the back edge of the board will engage the front edge of the relatively rigid support arm 18. The front of the board containing the contact pads 8 will engage the relatively more compliant contact spring 22 which is deflected away from the support arm 18 upon the insertion of the board into the board receiving slot 54. In this manner, the deflection of the relatively resilient contact spring 22 can be generally controlled. Note that the barrier wall 70 and the partition 72 have a lead in adjacent their upper end which positions the edge of the board generally between the relatively rigid support arm 18 and the more compliant contact spring 22.

The terminals 10 are held within the housing 50 by the engagement of the upwardly deflected tab 34 with the shoulder 66 located in the cavity. The raised section 36 located adjacent the opposite end of the terminal base is positioned to stabilize the terminal and prevent rotation. The slit 58 is located adjacent one side of the associate channel 52 and cavity 56 so that the portion of the U-shaped section of the contact terminal, adjacent the base, and offset along one side edge of the base 12 can be received within the slit 58. The slit 58 has a width less than the width of the cavities 56 and channels 54. The slit 58 provides a communication between the channel and the cavities in order to receive the terminals 10, but the transversely extending base section can still be received within the cavity 56 so that that the tab 34 and the raised surface 36 can engage that surface of the intermediate wall 64 which forms the upper portion of each of the cavities 56.

The electrical connector 102 comprising the alternate embodiment of this invention shown in FIGS. 9 through 16 has a electrical terminal 110 which differs in construction from the terminal 10. The connector 102 and terminals 110 are, however, configured to form an interconnection between a wire 6 and a printed circuit board 4. Terminal 110 also has a relatively rigid support arm 118 which extends perpendicular to a relatively more compliant resilient contact spring 122. Both the support arm 118 and the resilient contact spring 122 are integral with a base 112 and are formed upwardly from the base. The compliant contact spring 122 is formed up from the inner end of the base 112 and is inclined towards the support arm 118. The apex 126 of the contact spring 122 forms a contact point in the same fashion as the apex of the spring 22 comprises the contact point in the preferred embodiment of this invention. In the alternate embodiment of the electrical terminal 110, the wire crimp barrel 138 extends from one end of the base 112. A strain relief section 140 is located adjacent to the wire crimp barrel 138.

The housing 150 of another embodiment of this invention includes a plurality of channels 152 which intersect a board receiving slot 154. The board 4 is inserted into the housing adjacent its upper end and is received in the board receiving slot in much the same manner as with the preferred embodiment of this invention. The printed circuit board 4 inserted into the board receiving slot 154 will be positioned between the compliant contact spring 122 and the rigid support arm 118 which are located on opposite sides of the board receiving slot 154. Channels 152 of the alternate embodiment of this invention are formed by barrier walls 170 and partitions 172 located on opposite sides of the board receiving slot 154. As with the first described embodiment of this invention, the terminals 110 can be inserted through the front face 160 of the housing in a direction transverse to the orientation of the board receiving slot 154. Likewise, the printed circuit board can be inserted into the board receiving slot 154 through the upper face 162 of the housing.

The manner in which the terminal 110 is retained within the housing 150 differs from that of the first described embodiment. The terminal retention means of this alternate embodiment comprises a upwardly extending terminal retention lance 176 which comprises a molded plastic extension of the housing 150. This deflectable terminals retention lance 160 is received within a terminal retention aperture 178 located in the base 112 of the terminal 110.

Figure 17:
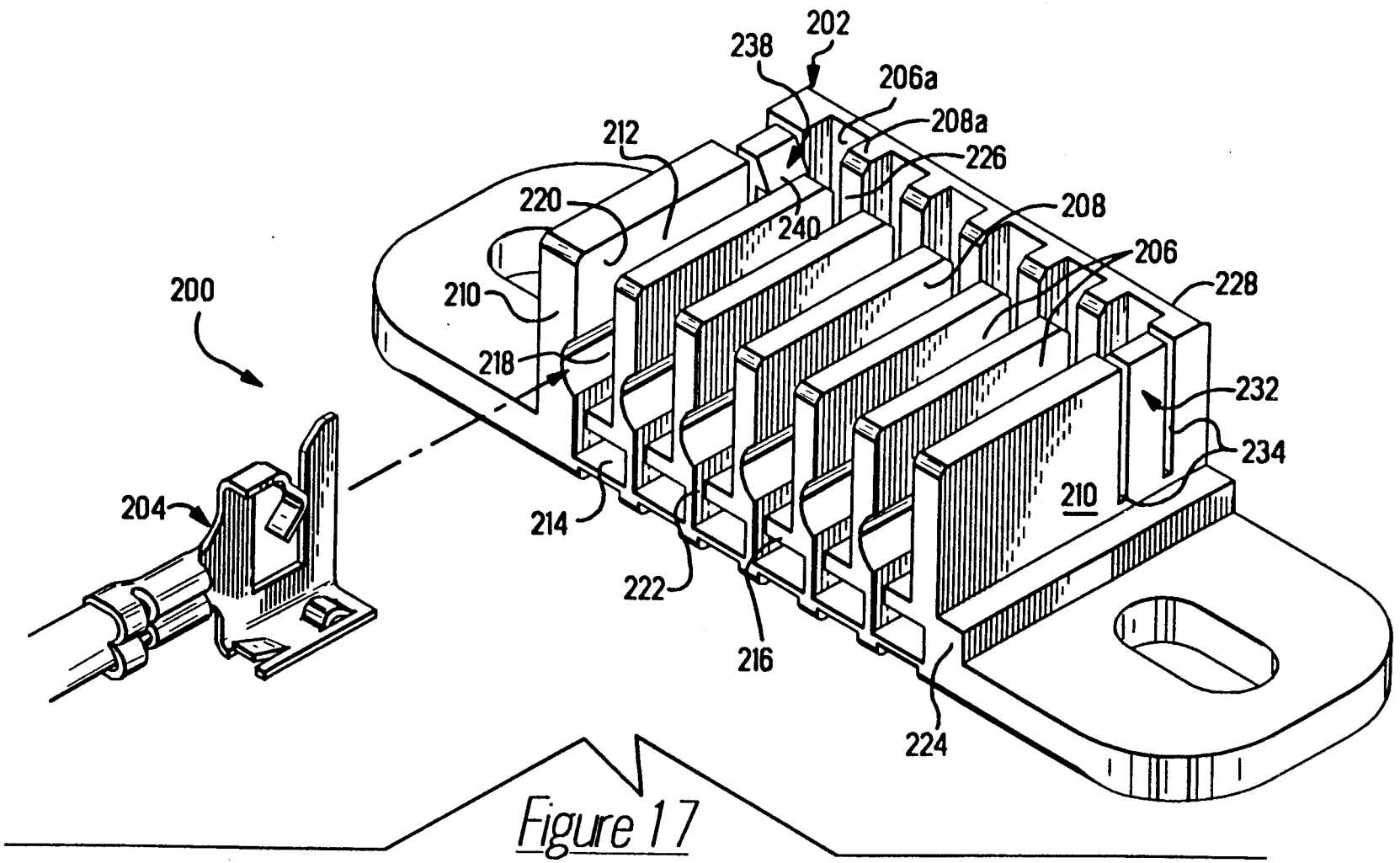
FIG. 17 is a perspective view of still another embodiment of the connector with a terminal exploded from an insulative housing.
Figure 18:
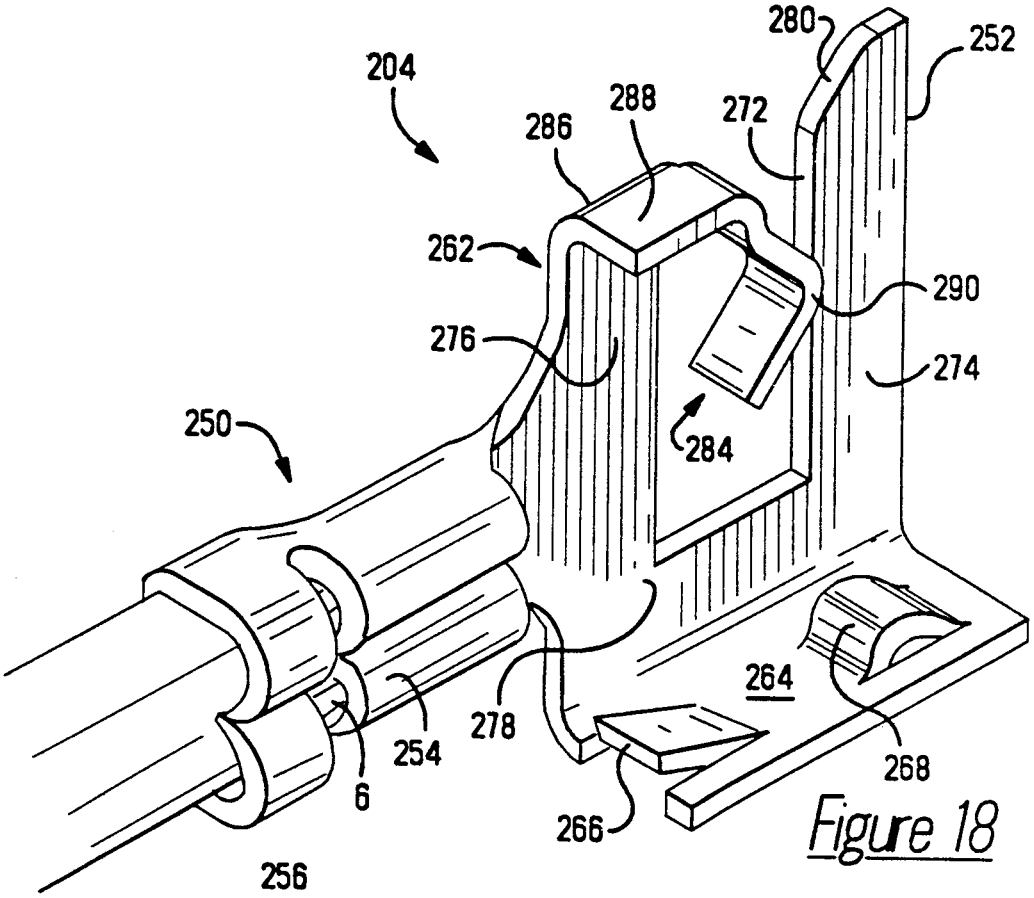
FIG. 18 is a perspective view of the terminal of FIG. 17.
Figure 19:
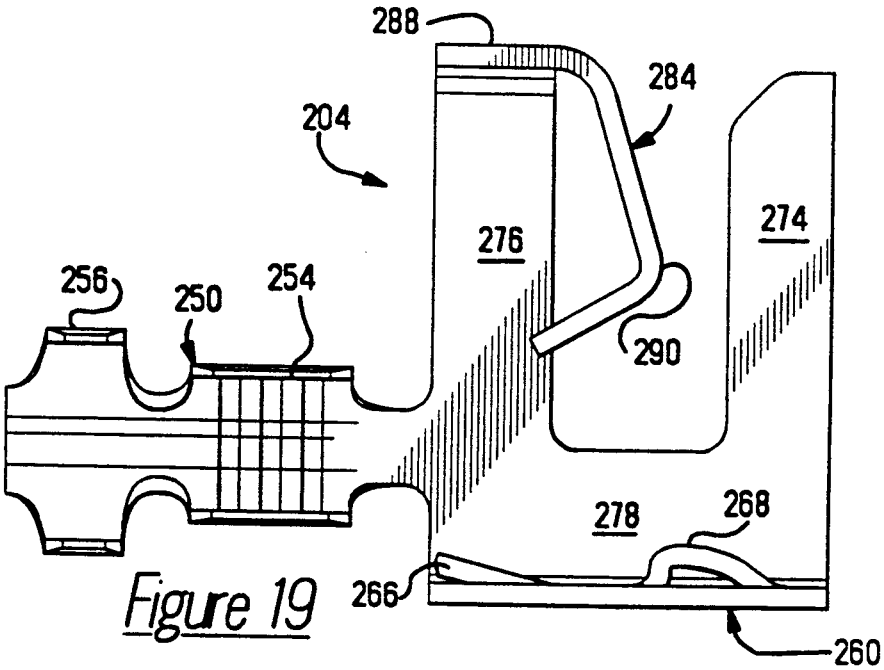
FIG. 19 is a side view of the terminal.

Another embodiment of the invention includes connector 200 shown in FIG. 17. Connector 200 comprises housing 202 of a dielectric material and terminals 204 stamped and formed from a conductive material.

Housing 202 contains a plurality of channels 206 which are defined by walls 208 and end walls 210. Channels 206 are further divided into upper portion 212 and lower portion 214 by shelf 216 which extends from surface 218 of walls 208, 210 towards facing surface 220 of adjacent walls 208, 210. Space 222 is provided between the free ends of shelf 216 and facing surface 220. As shown, lower portions 214 are wider than upper portions 212.

Channels 206 extend longitudinally from front face 224 to board receiving slot 226 which is normal to channels 206. Channels **206*a* are continuations of channels 206 on the opposite side of slot 226 and are defined by short walls 208*a* and back face wall 228. Channels 206*a* are not necessarily subdivided into uppper and lower portions as are channels 206**.

Arcuate shaped cutouts 230 are provided in facing surfaces 220 of walls 208, 210.

Board retaining latches 232 are located in end walls 210 and defined by parallel slits 234 which permit latches 232 to be resiliently cammed outwardly. Each latch 232 has a free end 236 a nose 238 having a slanted surface 240 and shoulder 242 facing downwardly. As can be seen in FIG. 17, latches 232 are in line with slot 226 and noses 238 project thereinto.

Terminals 204 are stamped and formed from a suitable conductive material such as phosphor bronze. Each terminal 204 has a wire contact section 250 at one end and a board contact section 252 at another end. Section 250 includes a wire ferrule 254 which is crimped about wire 6 and an insulation gripping ferrule 256.

Board contact section 252 includes base 260 and extending perpendicularly from one edge thereof a U-shaped member 262.

Base 260 includes a flat section 264 from which tab 266 extends obliquely outwardly from one end. A raised portion or bump 268, which is sheared along the sides is formed to project outwardly near an opposite end. Tab 266 and bump 268 comprise means to retain terminal 204 in channel 206 as will be noted below.

U-shaped member 262 has a board receiving slot 272 defined by spaced apart arms 274, 276 and bight 278 interconnecting arms 274, 276. Free end 280 of arm 274 is curved to provide a lead-in to slot 272.

A resilient contact spring arm 284 is attached to free end 286 of arm 276 by strap 288 which is normal to arm 276 and parallel to base 260. Spring arm 284 is generally parallel to the length of slot 272 and has a convex contact surface 290 which projects into board receiving slot 226 when terminal 204 is positioned in a channel 206. As shown, strap 288 spaces spring arm 284 away from the plane of arms 274, 276 and locates it over base 260.

Terminals 204 are loaded into and retained in channels **206, 206*a* as discussed above with reference to FIG. 4 and terminal 10. Board 292 (FIGS. 20, 21) is received in slots 272 with convex contact surfaces 290 electrically engaging circuit traces 294 (FIGS. 20, 21) on board 292**.

Figure 20:
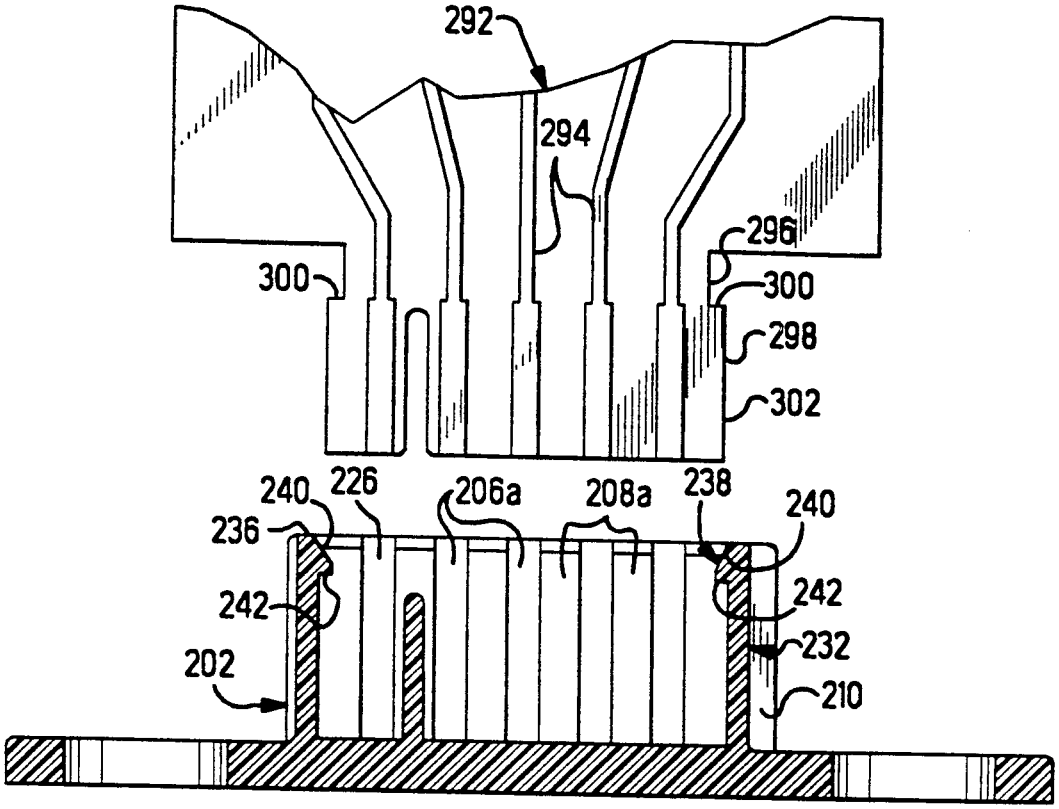
FIG. 20 is a front sectional view of the insulative housing with a circuit board thereabove.
Figure 21:
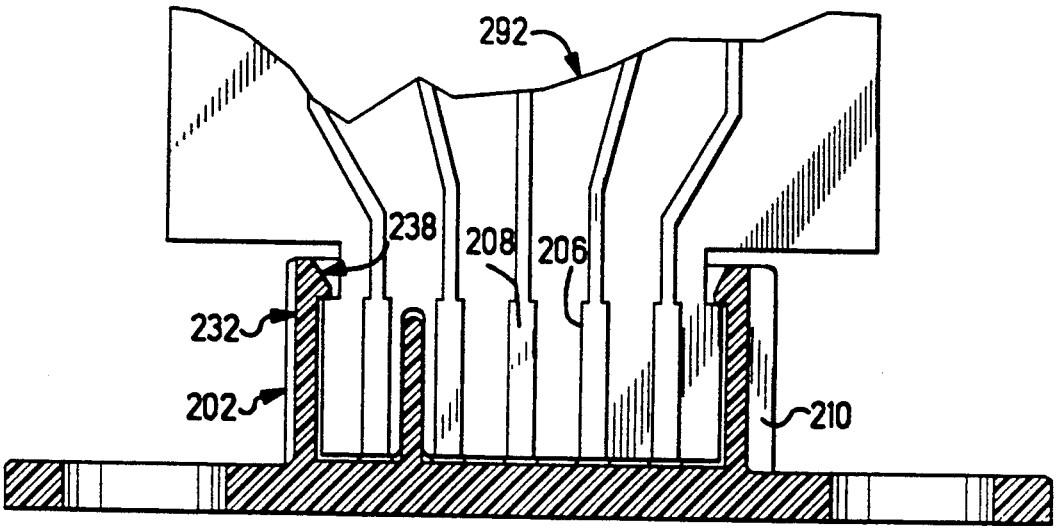
FIG. 21 is the same view as in FIG. 20 with the circuit board inserted into the insulative housing.

FIGS. 20 and 21 illustrate the cooperation of latches 232 with board 292. As shown, notches 296 in sides 298 of board 292 define shoulders 300. The width of edge portion 302 of board 292 is equal to the length of slot 226. As edge portion 302 is inserted into slot 226, the corners thereof engage slanted surfaces 240 and cam latches 232 outwardly so that noses 238 are outside of slot 226. Latches 232 return inwardly as noses 238 enter notches 296 whereupon shoulders 242 engage board shoulders 300 to retain board 292 in slot 226.

Each of the embodiments of this invention comprises a means for establishing a relatively controlled compliant contact with conductive pads located on one side of a printed circuit board. The position of the printed circuit board is relatively precisely determined by a rigid support arm extending upwardly in a position such that it is opposed to the more compliant contact spring. Thus, a metal to metal contact system is established with reproducible forces being established by the compliant contact spring on the conductive pads. The instant invention does not rely upon plastic for support of the printed circuit board or for support of the contacts. Thus, the contact force maintained on the conductive pads is not effected, over time, by creep or deformation of the plastic housing. It will be appreciated by those of ordinary skill in the art that other configurations, within the scope of the invention as depicted by the two embodiments shown herein. These alternate embodiments can employ a compliant contact spring having a contact surface opposed to an edge of a relatively more rigid support arm spaced on the opposite side of a board receiving slot in an insulative house. In the manner taught herein, without departing from the scope of the claims attached hereto.

We claim:

1. An electrical connector for electrically interconnecting signals from discrete wires to circuits on a circuit board, the connector comprising:

a. housing having spaced walls defining channels for receiving terminals, each having a concave cutout facing into respective said channels and further a circuit board-receiving slot intersecting said channels normal to said walls and located inwardly from the ends of said walls;

terminals having a base, a pair of coplanar arms bent upwardly from one edge of said base with a slot between said arms, a cantilever contact spring arm attached at one end to one of said arms and having a contact surface transverse to the plane of said arms and wire attaching means attached to a free edge of one of said arms and extending outwardly therefrom, said terminals disposed in said channels with said slots being in alignment with said slot in said housing and said wire attaching means being received in said concave cutouts and said contact surfaces on said contact spring arm protruding resiliently into said board-receiving slot to electrically engage a circuit board therein.

2. The connector of claim 1 wherein said spring arm is attached to a free end of one of said arms by a strap positioned normal to said arm and parallel to said base.

3. The connector of claim 1 further including means on said housing to cooperate with means on a circuit board to removably retain the board in said slot in said housing.

4. The connector of claim 3 wherein said means on said housing includes cantilevered latches one each end of said board-receiving slot, said latches having shoulders facing in one direction to engage shoulders on a circuit board facing an opposite direction.

* * * * *